US006994279B2

(12) United States Patent
Saito et al.

(10) Patent No.: US 6,994,279 B2
(45) Date of Patent: Feb. 7, 2006

(54) FUEL INJECTION DEVICE

(75) Inventors: Kimitaka Saito, Nagoya (JP); Yasuhide Tani, Nagoya (JP); Atsuya Okamoto, Okazaki (JP); Takeshi Mizobuchi, Okazaki (JP)

(73) Assignee: Denso Corporation, (JP)

( * ) Notice: Subject to any disclaimer, the term of this patent is extended or adjusted under 35 U.S.C. 154(b) by 147 days.

(21) Appl. No.: 10/461,457

(22) Filed: Jun. 16, 2003

(65) Prior Publication Data

US 2003/0234006 A1 Dec. 25, 2003

(30) Foreign Application Priority Data

Jun. 20, 2002 (JP) ..... 2002-179614
Apr. 18, 2003 (JP) ..... 2003-114961

(51) Int. Cl.
*F02M 61/00* (2006.01)

(52) U.S. Cl. ..... 239/533.12; 239/533.2; 239/596; 239/598; 239/601; 239/558; 239/585.1

(58) Field of Classification Search ..... 239/533.2, 239/533.12, 533.3, 596, 599, 598, 597, 601, 239/558, 559, 585.1, 585.4, 585.5
See application file for complete search history.

(56) References Cited

U.S. PATENT DOCUMENTS

| | | | | |
|---|---|---|---|---|
| 6,045,063 | A | 4/2000 | Koike et al. | |
| 6,070,812 | A | 6/2000 | Tani et al. | |
| 6,161,780 | A * | 12/2000 | Sugimoto et al. | 239/533.12 |
| 6,439,484 | B2 * | 8/2002 | Harata et al. | 239/596 |
| 2001/0042800 | A1 | 11/2001 | Sato | |

FOREIGN PATENT DOCUMENTS

| | | |
|---|---|---|
| JP | 11-62787 | 3/1999 |
| JP | 11-82246 | 3/1999 |
| JP | 11-270443 | 10/1999 |

* cited by examiner

*Primary Examiner*—Dinh Q. Nguyen
(74) *Attorney, Agent, or Firm*—Nixon & Vanderhye PC

(57) ABSTRACT

In an injection hole plate of a fuel injection device, injection holes are arranged about a circle. Fuel injected from the injection holes forms a flat sector-shaped spray. The intervals between adjacent injection holes are approximately equal to each other, while the diameters of the injection holes are equal to each other. An injection hole is positioned on an imaginary plane, which contains the central axis of the sector-shaped spray along the injection direction and is orthogonal or approximately orthogonal to the sector-shaped spray. The injection holes, away from the imaginary plane in this order, are symmetric with respect to the line of intersection of the injection hole plate and the imaginary plane. The farther each injection hole is away from the imaginary plane, the larger an angle of gradient of the injection hole with respect to the imaginary plane becomes.

19 Claims, 14 Drawing Sheets

FUEL INJECTION DEVICE

CROSS REFERENCE TO RELATED APPLICATIONS

This application is based upon, claims the benefit of priority of, and incorporates by reference, the contents of Japanese Patent Applications No. 2002-179614 filed Jun. 20, 2002, and No. 2003-114961 filed Apr. 18, 2003.

BACKGROUND OF THE INVENTION

1. Technical Field of the Invention

The present invention relates to a fuel injection device which injects a flat sector-shaped spray of fuel directly into the combustion chamber of an internal-combustion engine (hereinafter, the "internal-combustion engine" will simply be referred to as an "engine").

2. Description of the Related Art

In recent years, direct-injection gasoline engines in which a fuel injection device injects fuel directly into an engine combustion chamber have been available. Generally, direct-injection gasoline engines were introduced in order to improve fuel efficiency and obtain a level of high power output. The spray shape of the fuel injected from the fuel injection device varies according to the specifications of the engine. In order to obtain a flat sector-shaped spray 308, as shown in FIGS. 22A and 22B, for example, a fuel injection device with a single flat sector-shaped injection hole 302 formed in a valve body 300 is known, in which the valve body 300 has a valve seat 304 and a nozzle needle 306 is seated on the valve seat 304.

The injection hole 302, however, is long in an injection direction because the hole 302 is formed in the valve body 300. Since it is difficult to form the injection hole 302 with press working, the injection hole 302 has to be formed with laser machining or electric discharge machining. However, there is a problem that machining time takes too long because the injection hole 302 is long in the injection direction. Also the fuel injection device has a low degree of flexibility in changing the shape of the spray 308, the concentration distribution of the spray 308 and the like, due to the single injection hole 302.

Japanese Patent Laid-Open Publication No. Hei 11-62787, as shown in FIGS. 23A and 23B, discloses a fuel injection device having a plurality of injection holes 311 formed in an orifice plate 310 to realize a flat sector-shaped spray 314. In this fuel injection device, however, the interval between the injection holes 311 is small, because the plurality of injection holes 311 are formed in a line within the limited area of the orifice plate 310. Since the fuel injection device of the direct-injection gasoline engine injects the fuel at a high pressure, as compared to a fuel injection device injecting fuel into an induction pipe, the narrow intervals between the injection holes 311 decrease the strength of the orifice plate 310 in an area where the injection holes 311 are formed, so that it is difficult for the plate 310 to endure the high fuel injection pressure. Additionally, the spray injected from the respective injection holes interfere and unite with each other due to the narrow intervals between the injection holes 311. It is impossible to inject the fuel from the respective injection holes in desired directions, so that there are many cases where the fuel is not injected in the desired shape.

Thickening the orifice plate 310 can increase the strength of the orifice plate 310, even if the interval between the injection holes 311 is narrow. When the orifice plate 310 is made thick, however, it becomes difficult to form the injection holes 311 by press working. In a case of machining the injection holes 311 by laser machining or electric discharge machining, a long machining time is necessary.

Thickening the orifice plate 310 makes the injection holes 311 long in the injection direction, so that fuel flow is rectified while flowing through the injection holes 311. The more turbulent the fuel flow passing through the injection holes 311 is, the greater the atomization will be of the spray 311 injected from the injection holes 311. Therefore, there is a problem that the fuel spray injected from the injection holes 311 is prevented from being atomized. That is, if the fuel flow is rectified while flowing through the lengthened injection holes 311.

An object of the present invention is to provide a fuel injection device for a direct-injection engine, which is easily manufactured with high strength, has a high degree of flexibility with regard to changing the concentration distribution or shape of a flat sector-shaped spray, and promotes the atomization of the fuel spray.

SUMMARY OF THE INVENTION

In a fuel injection device according to the multiple aspects of the present invention, a plurality of injection holes formed in an injection hole plate include three or more outermost injection holes arranged on the same circle. In this invention, the case in which there are outermost injection holes includes the case in which additional injection holes are formed inside the outmost injection holes. Additionally, it includes the case in which the additional injection holes are not formed inside the outermost injection holes but all holes are the outermost injection holes, arranged along the same circle, and are formed in the injection hole plate. In this invention, a circular arrangement of the holes includes a perfect, true circle and an ellipse.

Arranging the three or more outermost injection holes on the same circle makes it possible to widen intervals between the outermost injection holes, in comparison with a case where the injection holes are arranged in line, for example, if the area of the injection hole plate in which the injection holes are to be formed is the same. Furthermore, according to the invention in one aspect, since circumferential intervals between the outermost adjacent injection holes are essentially equal, it is possible to increase the intervals between the three or more injection holes of an outermost circle. Accordingly, the strength of the injection hole plate increases in an area where the outermost injection holes are formed, even if the thickness of the injection hole plate is thin, so that it is possible to make the thickness of the injection hole plate thin. Thus, the injection holes can be machined with ease by press working, i.e., pressing. Applying laser machining or electric discharge machining makes it possible to shorten any machining time. The thin injection hole plate promotes fuel spray atomization.

When the intervals between the outermost injection holes increase, it is possible to prevent spray injected from the outermost injection holes from interfering and uniting with each other, so that the atomization of the fuel spray is promoted. Preventing the interference of the spray also makes it possible to obtain the shape of the spray desired by means of injecting fuel in desired directions from the outermost injection holes. Since spray injected from the plurality of injection holes forms a sector-shaped spray, the fuel injection device has a high degree of flexibility in changing the concentration distribution or shape of the sector-shaped spray by adjusting the diameter or injection direction of each injection hole.

Even if the fuel injection device is installed in the same position of an engine, it is possible to vary the injection direction of the sector-shaped spray by inclining the sector-shaped spray with respect to an axial line along the seating direction of a valve member on a valve seat, as in the fuel injection device described in a second aspect of the present invention. Accordingly, when the fuel injection device is installed in a skewed fashion in such a manner that the fuel is injected on the wall forming the combustion chamber, while avoiding the spark plug, along the axial line of the fuel injection device, the liquefaction of the fuel due to the fuel adhering to the wall of the combustion chamber is prevented as much as possible.

In the fuel injection device according to a third aspect of the present invention, the farther the injection hole is away from an inclined side of the sector-shaped spray, the more inclined the injection hole is to a spread direction of the sector-shaped spray with respect to a central axis of the sector-shaped spray along the injection direction, so that it is possible to prevent the spray, injected from each injection hole to form the sector-shaped spray, from interfering and uniting with each other. Therefore, it is possible to promote the atomization of the sector-shaped spray which is inclined with respect to the axial line of the fuel injection device. It is also possible to obtain the desired shape of the spray, by means of injecting the fuel from a plurality of injection holes formed in the injection hole plate, in desired directions.

In the fuel injection device according to a fourth aspect of the preset invention, the farther the injection hole is away from an imaginary plane, which contains a central axis of the sector-shaped spray along an injection direction and is orthogonal to the sector-shaped spray, the larger an angle of gradient becomes, with respect to the imaginary plane. Namely, the farther the injection hole is away from the imaginary plane, the farther the spray therefrom is away from the center of the sector-shaped spray. In other words, the nearer the injection hole is to the imaginary plane, the smaller the angle of gradient with respect to the imaginary plane becomes. Namely, the nearer the injection hole is to the imaginary plane, the nearer the spray is to the center of the sector-shaped spray. The spray injected from the respective injection holes formed in the injection hole plate do not overlap one another in the sector-shaped spray, so that the atomization of the spray injected from the respective injection holes is not prevented.

In the fuel injection device according to a fifth aspect of the present invention, intervals between the outermost injection holes adjacent to each other in a circumferential direction are almost equal, so that it is possible to widen the intervals between the outermost injection holes as much as possible. Accordingly, the strength of the injection hole plate increases in an area where the outermost injection holes are formed.

In the fuel injection device according to a sixth and seventh aspect of the present invention, and injection hole is formed inside the outermost injection holes, so that it is possible to widen the intervals of the injection holes, in comparison with a case where the injection holes are formed only in the outermost circle. Accordingly, the strength of the injection hole plate increases.

In the fuel injection device according to an eighth aspect of the present invention, outer and inner injection hole groups are constituted by a plurality of injection holes formed and arranged on a plurality of concentric circles. Intervals between the injection holes adjacent to each other in the circumferential direction of each circle are almost equal, so that it is possible to widen the intervals between the injection holes on each circle as much as possible. Accordingly, the strength of the injection hole plate increases in an area where the injection holes are formed.

In the fuel injection device according to a ninth aspect of the present invention, three or more inner injection holes are formed inside the outermost injection holes, and intervals between adjacent inner injection holes are almost equal. Accordingly, since it is possible to widen the intervals between the injection holes as much as possible, the strength of the injection hole plate increases in an area where the injection holes are formed.

In the fuel injection device according to a tenth aspect of the present invention, intervals between the inner injection hole and the outermost injection hole adjacent thereto are almost equal, so that it is possible to widen the interval between the inner injection hole and the outermost injection hole as much as possible. Accordingly, the strength of the injection hole plate increases in an area where the injection holes are formed.

In the fuel injection device according to an eleventh aspect of the present invention, a plurality of the inner injection holes is formed inside the outermost injection holes. Intervals between each inner injection hole and the outermost injection hole adjacent thereto and between each inner injection hole and an adjacent inner injection hole are almost equal, so that it is possible to make the intervals between the injection holes formed in the injection hole plate almost equal. Therefore, it is possible to widen the intervals between the injection holes as much as possible. Therefore, the strength of the injection hole plate increases in an area where the injection holes are formed.

In the fuel injection device according to a thirteenth aspect of the present invention, the diameters of the injection holes formed in the injection hole plate are equal, so that the amount of fuel injected from each injection hole is equal. Since the concentration of the sector-shaped spray is even, it is possible to prevent a decrease in the power output of an engine and prevent an increase in the amount of non-combusted fuel.

In the fuel injection device according to a fourteenth aspect of the present invention, the diameters of the injection holes formed in the injection hole plate are different from each other. Namely, there are injection holes, among the plurality of injection holes, with different diameters. It is possible to adjust the concentration of the sector-shaped spray by means of adjusting the diameters of the injection holes in accordance with engine requirements.

When the diameter of an injection hole is made small relative to the thickness of the injection hole plate, i.e., when the length of the injection hole in the injection direction is long relative to the diameter of the injection hole, the fuel injected from the injection hole is less atomized because fuel flow is rectified within the injection hole.

In the fuel injection device according to a fifteenth aspect of the present invention, the injection hole plate is designed so as to satisfy the following formula: $t/d \leqq 1.5$, wherein "t" is the thickness of the injection hole plate, and "d" is the diameter of the plurality of injection holes. Fuel atomization is promoted because the thickness "t" of the injection hole plate, and more specifically, the upper limit of the length of the injection hole in the injection direction, is determined relative to the diameter "d" of the injection hole.

In the fuel injection device according to a sixteenth aspect of the present invention, an end surface of the valve member on the side of the injection hole plate and an end surface of the injection hole plate on the side of the valve member form an approximately flat fuel space. Accordingly, when the valve member leaves the valve seat, fuel flows through the opening between the valve member and the valve seat and into the injection holes and becomes parallel flow along the end surface of the injection hole plate on the valve member side. The separate fuel flows then collide with each other. The colliding fuel flows become turbulent flows and are injected from the respective injection holes. The more turbulent the fuel flows are, the more atomized the spray injected from the respective injection holes become.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

First Embodiment

Figure 4:
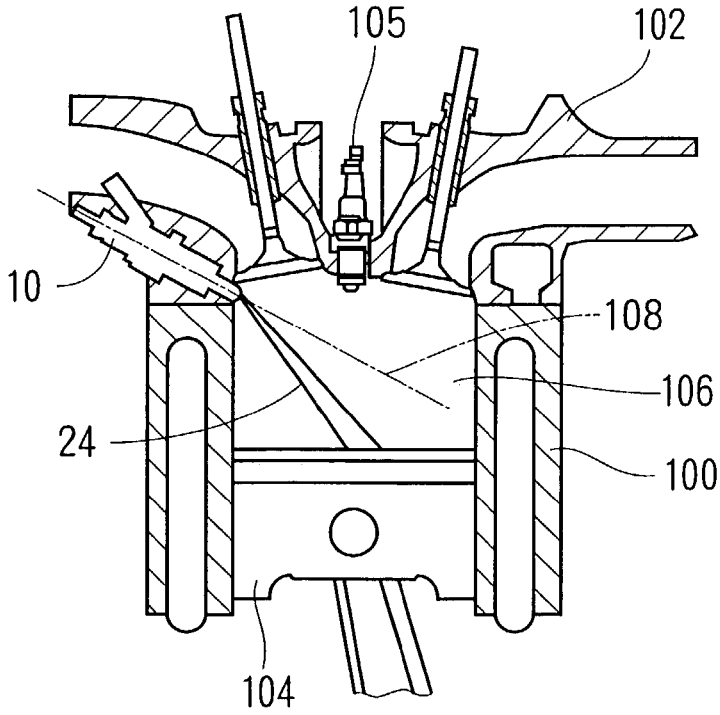
FIG. 4 is a cross-sectional view showing the attachment position of the injector, and the spray condition of the fuel into a combustion chamber according to the first embodiment.
Figure 5:
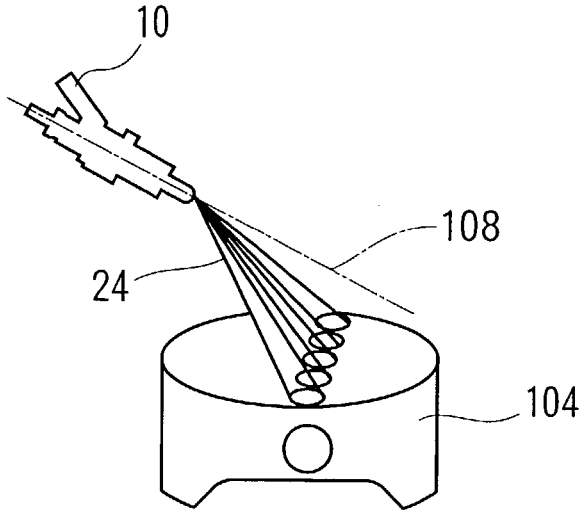
FIG. 5 is a perspective view showing the spray condition of the injector according to the first embodiment.

FIG. 4 shows a first embodiment of the present invention. An injector 10 is attached to a cylinder head 102. The injector 10 is the fuel injection device of a direct-injection gasoline engine which injects fuel directly into a combustion chamber 106 formed by the inner surface of a cylinder block 100, the inner surface of the cylinder head 102, and the upper surface of a piston 104. The fuel injection pressure of the injector 10 is 10 MPa to 30 MPa. A spray 24 of fuel from the injector 10 is in the shape of a flat sector, as shown in FIGS. 4 and 5. The sector-shaped spray 24 travels away from an axial line 108 of the injector 10 and becomes inclined with respect to the axial line 108 as the spray 24 advances in the injection direction, as shown in FIG. 5. The axial line 108 is a line along a seating direction of a valve member 30 of the injector 10 on a valve seat 14. Setting a suitable angle for inclining the sector-shaped spray 24 with respect to the axial line 108 of the injector 10 makes it possible to prevent the sector-shaped spray 24 from adhering to a spark plug 105, the piston 104, and the inner surface of the cylinder block 100, which form the combustion chamber 106, so that the liquefaction of the sector-shaped spray 24 is prevented.

Figure 2:
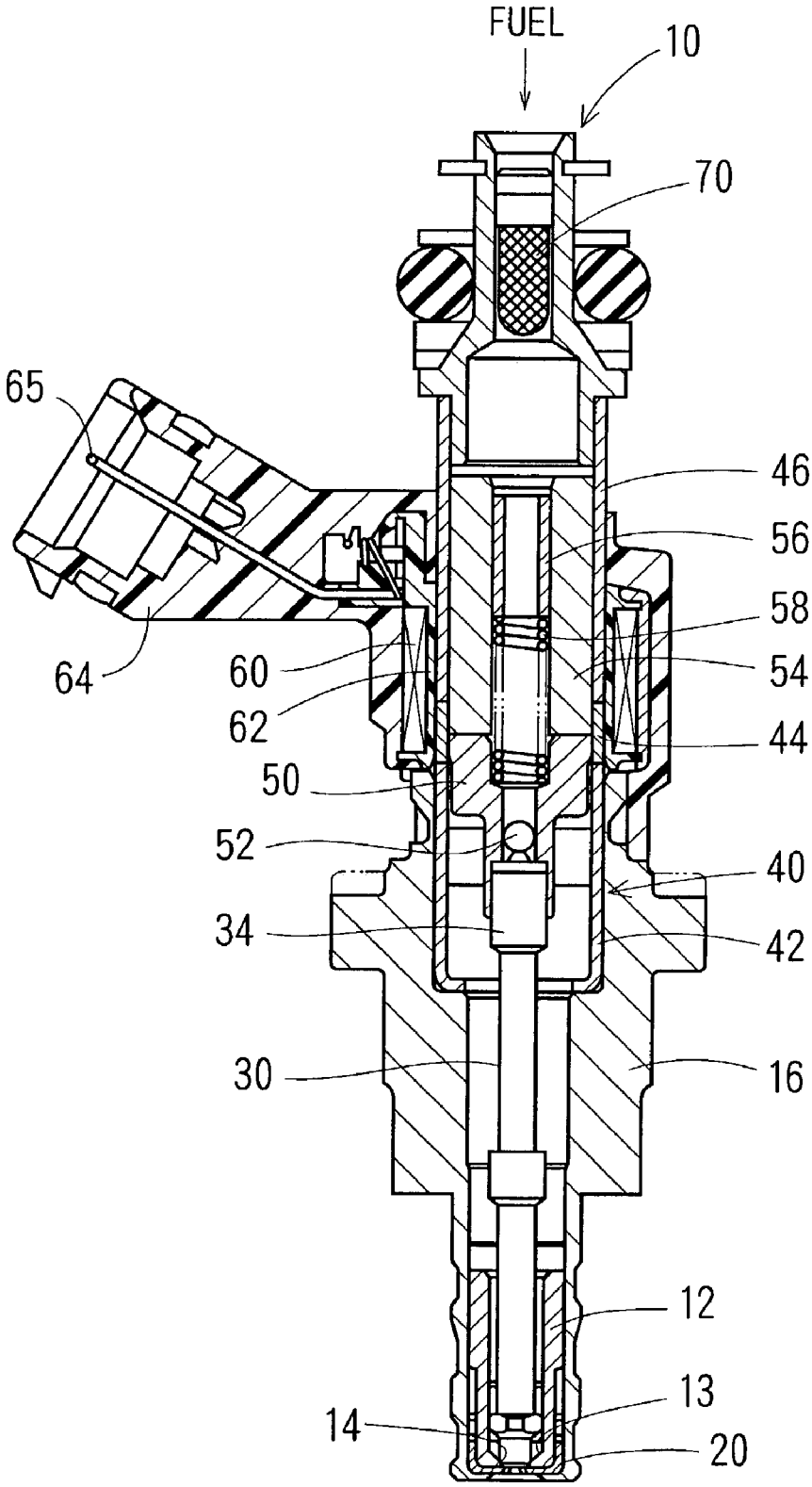
FIG. 2 is a cross-sectional view of an injector according to the first embodiment.

A valve body 12, as shown in FIG. 2, is welded to the inner wall of an end of a valve housing 16 on the fuel injection side. The valve body 12 has a conical inner surface 13 the diameter of which converges on the injection hole plate 20 side of a fuel flow direction. The valve seat 14, on which a nozzle needle 30 as a valve member is seatable, is formed in the conical surface 13.

Figure 1A:
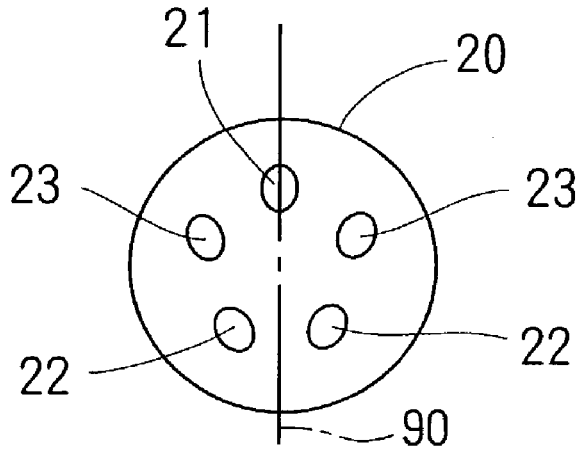
FIG. 1A is a plan view of an injection hole plate according to a first embodiment of the present invention.
Figure 1B:
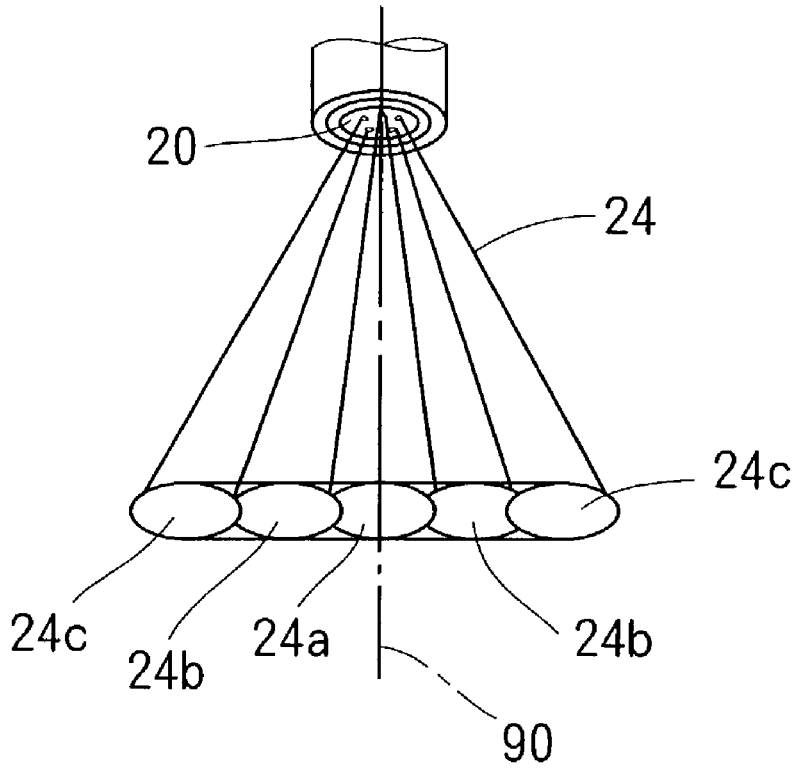
FIG. 1B is a schematic diagram showing a spray shape according to the first embodiment of the present invention.

The injection hole plate 20, which is formed in a tubular shape with a bottom, is held between the bottom inner surface of the valve housing 16 and the bottom outer surface of the valve body 12. In the injection hole plate 20, as shown in FIG. 1, there are five injection holes 21, 22, and 23 in total, formed and arranged on the same outermost circle. In this embodiment, the circle is any of a perfect circle and an ellipse. The injection holes 21, 22, and 23 are formed by press working, laser machining, or electric discharge machining. In this embodiment, as described above, all injection holes are formed and arranged on the single circle. In a case where no injection hole is formed inside the circle, this embodiment dictates that the injection holes are formed and arranged on the same outermost circle. The intervals between the adjacent injection holes in a circumferential direction are approximately equal, and the diameters of the respective injection holes are equal to each other. The fuel injection from the injection holes 21, 22, and 23 is interrupted when the nozzle needle 30 is seated on the valve seat 14, and fuel injection therefrom is permitted when the nozzle needle 30 leaves the valve seat 14.

Figure 3:
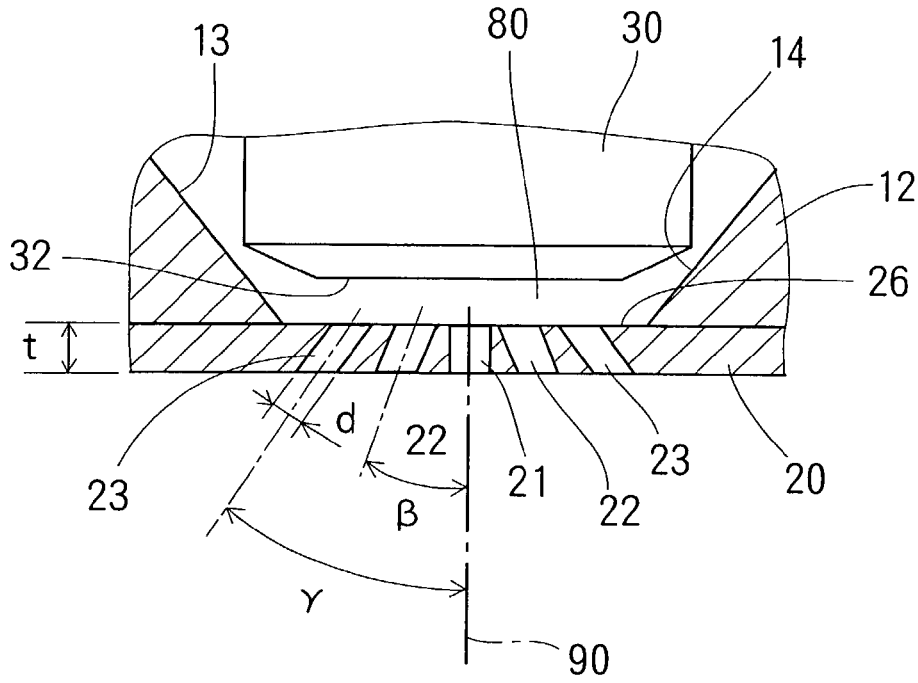
FIG. 3 is a schematic cross-sectional view showing the vicinity of an injection hole according to the first embodiment.

Referring to FIG. 3, an end surface 32 of the nozzle needle 30 on an injection hole plate side is flat. A fuel space 80 defined by the end surface 32 on the injection hole plate side and an end surface 26 of the injection hole plate 20 on a nozzle needle side is flat. The injection hole plate 20 is designed so as to satisfy the following formula: $t/d \leqq 1.5$, wherein "t" is the thickness of the injection hole plate 20, and "d" is the diameter of each of the injection holes.

As shown in FIG. 2, a tube member 40, inserted into the inner periphery of the valve housing 16 on the opposite side of the injection holes, is secured to the valve housing 16 by welding. The tube member 40 comprises a first magnetic tubular portion 42, a non-magnetic tubular portion 44, and a second magnetic tubular portion 46 disposed in this order from the injection hole plate 20. The non-magnetic tubular portion 44 prevents the first and second tubular portions 42, 46 from shorting out, magnetically.

A movable core 50, made of a magnetic material into a tubular shape, is welded to an end 34 of the nozzle needle 30 on the opposite side of the injection holes. The movable core 50 reciprocates with the nozzle needle 30. A discharge hole 52 penetrating through the tubular wall of the movable core 50 forms a fuel path that connects the inside and outside of the movable core 50.

A fixed core 54 is made of a magnetic material in a tubular shape. The fixed core 54 inserted into the tube member 40 is secured to the tube member 40 by welding. The fixed core 54 is disposed farther from the injection holes than the movable core 50, in such a manner as to face the movable core 50.

An adjusting pipe 56, which is fitted by pressure into the fixed core 54, forms the fuel path in the fixed core 54. One end of a spring 58 is secured to the adjusting pipe 56, and the other end of the spring 58 is secured to the movable core 50. Adjusting the amount of press-fit of the adjusting pipe 56 makes it possible to vary the load of the spring 58 added to the movable core 50. The biasing force of the spring 58 biases the movable core 50 and the nozzle needle 30 toward the valve seat 14.

A coil 60 is wound on a spool 62. A terminal 65 insert molded into a connector 64 is electrically connected to the coil 60. When the coil 60 is energized, a magnetic attraction force is created between the movable core 50 and the fixed core 54, so that the movable core 50 is attracted to a fixed core 54 side against the biasing force of the spring 58.

A filter 70 disposed upstream of the fuel flow in the fixed core 54 eliminates foreign substances in the fuel supplied to the injector 10. The fuel flowing into the fixed core 54 through the filter 70 sequentially passes through the fuel path inside the adjusting pipe 56, the fuel path inside the movable core 50, the discharge hole 52, and space between the inner periphery of the valve housing 16 and the outer periphery of the nozzle needle 30. When the nozzle needle 30 leaves the valve seat 14, the fuel flowing through an opening path formed between the nozzle needle 30 and the valve seat 14 is led to the injection holes 21, 22, and 23.

The arrangement of the injection holes 21, 22, and 23 formed in the injection hole plate 20, and the shape of a spray will be hereinafter described in detail. Spray injected from the respective injection holes form the flat sector-shaped spray 24, as shown in FIG. 1. The injection hole 21 is positioned on an imaginary plane 90, which contains the central axis of the sector-shaped spray 24 along the injection direction and is orthogonal to the sector-shaped spray 24. The injection holes 22 and the injection holes 23, which are away from the imaginary plane 90 in this order, are symmetric with respect to the line of intersection of the injection hole plate 20 and the imaginary plane 90. Referring to FIG. 3, when the angle of gradient of the injection hole 21 with respect to the imaginary plane 90 is $\alpha$ (not illustrated in FIG. 3), the angle of gradient of the injection hole 22 is $\beta$, and the angle of gradient of the injection hole 23 is $\gamma$, the angles $\alpha$, $\beta$, and $\gamma$ satisfy the following formula: $\alpha<\beta<\gamma$, where $\alpha=0$. In other words, the farther the injection hole is away from the imaginary plane 90, the larger the angle of gradient of each injection hole, with respect to the imaginary plane 90, becomes.

When the angle of gradient with respect to the imaginary plane 90 is large, the spray injected from the injection hole is apart from the center of the sector-shaped spray 24. Accordingly, as shown in FIG. 1, a spray 24*a* injected from the injection hole 21 is positioned in the middle of the sector-shaped spray 24, spray 24*b* injected from the injection holes 22 are positioned outside the spray 24*a*, and spray 24*c* injected from the injection holes 23 are positioned outside the spray 24*b*. The spray injected from the respective injection holes form the sector-shaped spray 24 without overlapping one another, so that the atomization of the sector-shaped spray 24 is not prevented.

The spray density of the sector-shaped spray 24 is even in the spread direction thereof, because the diameters of the respective injection holes are equal and the amounts of fuel injected from the respective injection holes are equal. In other words, the evenness of the sector-shaped spray 24 is improved. Improving the evenness of the sector-shaped spray 24 makes it possible to obtain good combustion, because there is no area with especially high concentration or low concentration in the sector-shaped spray 24. Therefore, it is possible to prevent decreases in engine power output, and to decrease the amount of non-combusted fuel.

In the first embodiment, the flat fuel space 80 is defined by the end surface 32 of the nozzle needle 30 on the injection hole plate side and the end surface 26 of the injection hole plate 20 on the nozzle needle side. When the nozzle needle 30 leaves the valve seat 14, the fuel flowing into the fuel space 80 through the opening between the nozzle needle 30 and the valve seat 14 is led by end surface 32 of the nozzle needle 30 on the injection hole plate side and the end surface 26 of the injection hole plate 20 on the nozzle needle side, to become parallel flows along the injection hole plate 20.

The parallel fuel flows along the injection hole plate 20 collide with each other and become turbulent flow. The turbulent flow is injected from each injection hole. Injecting of the turbulent fuel flow from each injection hole promotes the atomization of the spray.

As the thickness "t" of the injection hole plate 20 and the diameter "d" of each injection hole satisfy the formula of $t/d \leqq 1.5$, the upper limit of the thickness "t" is determined, relative to the diameter "d" of the injection hole. Because the thickness "t" does not become too thick relative to the diameter "d" of the injection hole, namely the length of each injection hole does not become too long in the injection direction, the fuel flowing into each injection hole is or becomes turbulent flow and is prevented from being rectified while passing through each injection hole. Accordingly, the atomization of the spray is promoted.

Second Embodiment

Figure 6A:
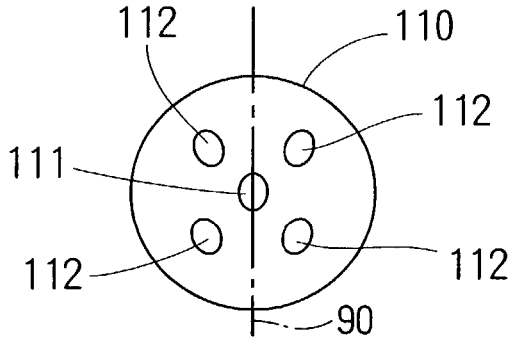
FIG. 6A is a plan view of an injection hole plate according to a second embodiment of the present invention.
Figure 6B:
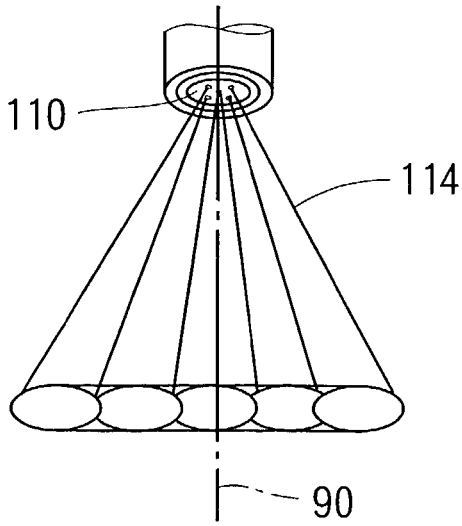
FIG. 6B is a schematic diagram showing a spray shape according to a second embodiment of the present invention.

FIG. 6 shows a second embodiment of the present invention. Five injection holes 111 and 112 in total, the diameters of which are equal to each other, are formed in an injection hole plate 110. The injection hole 111 as an inside injection hole is formed in the middle of the injection hole plate 110, and the other four injection holes 112 are formed and arranged on the same outermost circle. The injection hole 111 is on the imaginary plane 90, and the injection holes 112 are symmetrically positioned with respect to the line of intersection of the injection hole plate 110 and the imaginary plane 90. The intervals between the adjacent injection holes 112 in a circumferential direction are almost equal. The two injection holes 112 positioned on both sides of the imaginary plane 90 are at the same distance away from the imaginary plane 90, but the angles of gradient thereof with respect to the imaginary plane 90 are different.

Spray injected from the injection holes 111 and 112 form a flat sector-shaped spray 114, and spray concentration in the sector-shaped spray 114 is almost even.

Third Embodiment

Figure 7A:
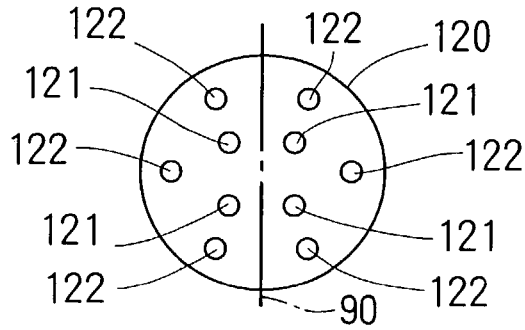
FIG. 7A is a plan view of an injection hole plate according to a third embodiment of the present invention.
Figure 7B:
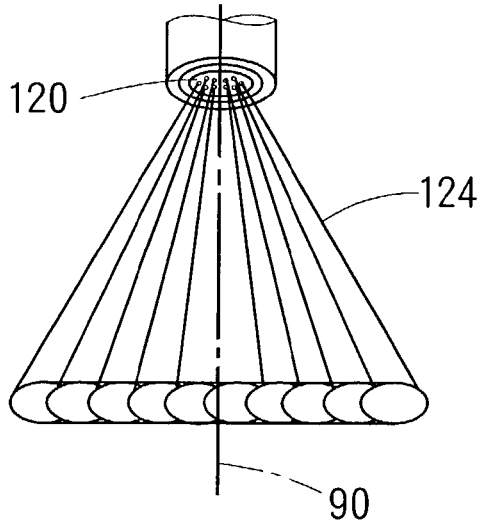
FIG. 7B is a schematic diagram showing a spray shape according to the third embodiment of the present invention.

FIG. 7 shows a third embodiment of the present invention. Ten injection holes 121, 122 in total, the diameters of which are equal to each other, are formed in an injection hole plate 120. The four injection holes 121 constituting an inner injection hole group are formed and arranged on an inner circle, the other six injection holes 122 are formed and arranged on the outermost circle, in such a manner that the intervals between the adjacent injection holes 121 and 122 in a circumferential direction are almost equal. The injection holes 121, 122 are symmetrically positioned with respect to the line of intersection of the injection hole plate 120 and the imaginary plane 90. The inner circle, on which the injection holes 121 as the inside injection holes are positioned, and the outermost circle, on which the injection holes 122 are positioned, are concentric circles. Even if the inner circle, in which the injection holes 121 are positioned, or the outermost circle, in which the injection holes 122 are positioned, is an ellipse, the inner circle and the outermost circle are regarded as the concentric circles in this embodiment, as long as the centers of the perfect circle and the ellipse coincide with each other. The injection holes 121 are almost equally disposed within the injection holes 122, exclusive of the center of the injection hole plate 110. The farther each injection hole is away from the imaginary plane 90, the larger the angle of gradient becomes. The angles of gradient of the injection holes at the same distance away from the imaginary plane 90 are varied. Spray injected from the injection holes 121, 122 form a flat sector-shaped spray 124, and spray concentration in the sector-shaped spray 124 is almost even.

In the third embodiment, the spray injected from each injection hole does not overlap in the sector-shaped spray, because the farther each injection hole is away from the imaginary plane 90, the larger the angle of gradient becomes. Therefore, the atomization of the spray from each injection hole is not prevented.

Fourth Embodiment

Figure 8:
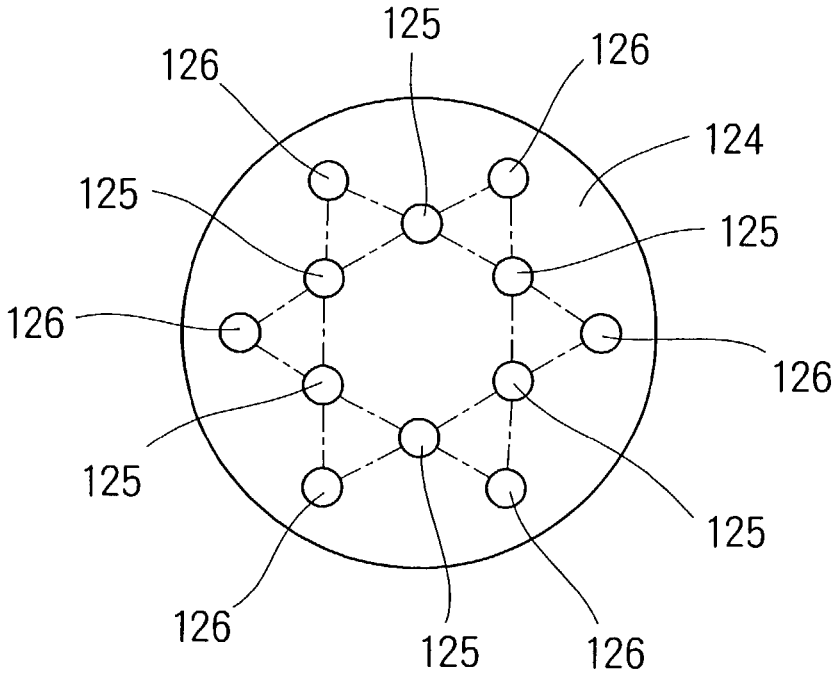
FIG. 8 is a plan view of an injection hole plate according to a fourth embodiment.

FIG. 8 shows a fourth embodiment of the present invention. Six injection holes 125 and six injection holes 126, the diameters of which are equal to each other, are formed in an injection hole plate 124. The six injection holes 125 constituting an inner injection hole group are formed and arranged on an inner circle, the other six injection holes 126 constituting an outer injection hole group are formed and arranged on the outermost circle. The holes are arranged in such a manner that the intervals between the adjacent injection holes in a circumferential direction are almost equal.

The intervals between the adjacent injection holes connected by alternate long and short dashed lines in FIG. 8 are almost equal. That is, the three distances formed by 1) an outer injection hole 126 and its closest two inner injection holes 125, and 2) the distance between the same two injection holes 125 that are closest to the outer injection hole 126 of "1" above, are nearly equal. According to this structure, it is possible to increase the strength of the injection hole plate 124, by means of widening the intervals between the injection holes as much as possible.

Fifth Embodiment

Figure 9A:
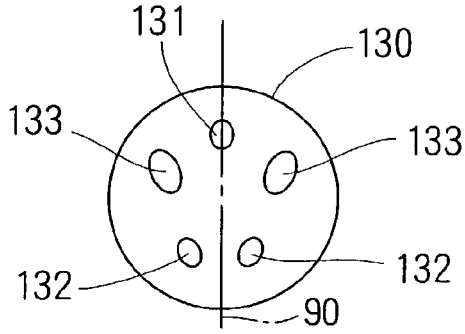
FIG. 9A is a plan view of an injection hole plate according to a fifth embodiment of the present invention.
Figure 9B:
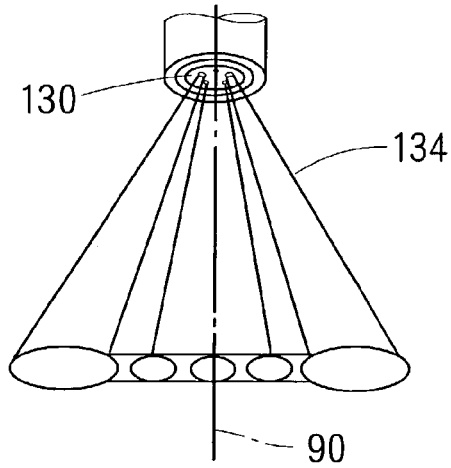
FIG. 9B is a schematic diagram showing a spray shape.

FIGS. 9A and 9B show a fifth embodiment of the present invention. Five injection holes 131, 132, and 133 in total are formed in an injection hole plate 130. The injection hole 131 is positioned on the imaginary plane 90. The injection holes 132 and the injection holes 133, which are farther away from the imaginary plane 90 in this order, are symmetric with respect to the line of intersection of the injection hole plate 130 and the imaginary plane 90. The farther the injection holes are away from the imaginary plane 90, the larger the angles of gradient formed by the injection holes 142, 143 with respect to the imaginary plane 90 become.

Spray streams injected from the injection holes 131, 132 are positioned in the middle of a sector-shaped spray 134, and spray streams injected from the injection holes 133 are positioned outside the sector-shaped spray 134 in a spread fashion. The diameters of the injection holes 131, 132 are equal to each other, and the diameter of the injection hole 133 is larger than those of the injection holes 131, 132. The amount of fuel injected from the injection hole 133 is more than that from any individual injection hole 131, 132, so that spray concentration is higher in the outer area of the sector-shaped spray 134 than in the middle. Accordingly, the force of penetration is larger in the outer area of the sector-shaped spray 134 than in the middle.

Sixth Embodiment

Figure 10B:
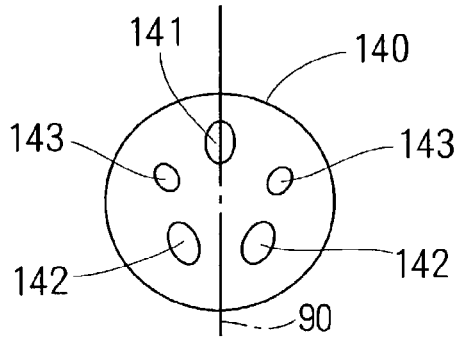
FIG. 10B is a schematic diagram showing a spray shape.
Figure 10A:
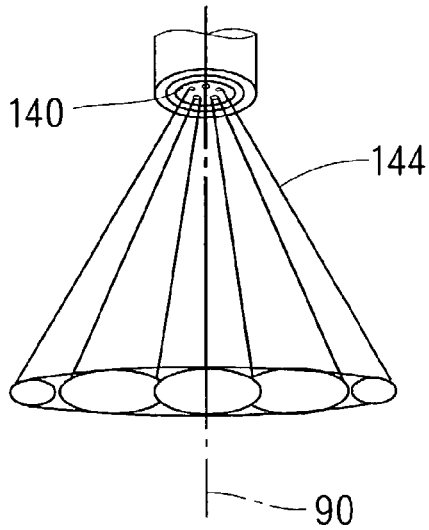
FIG. 10A is a plan view of an injection hole plate according to a sixth embodiment of the present invention.

FIG. 10 shows a sixth embodiment of the present invention. Five injection holes 141, 142, and 143 in total are formed in an injection hole plate 140. The injection hole 141 is positioned on the imaginary plane 90. The injection holes 142 and the injection holes 143, which are, in this order, increasingly farther away from the imaginary plane 90, are symmetric with respect to the line of intersection of the injection hole plate 140 and the imaginary plane 90. The farther the injection holes 142, 143 are away from the imaginary plane 90, the larger the angles of gradient formed by the injection holes 142, 143 with respect to the imaginary plane 90 become.

Spray injected from the injection holes 141, 142 are positioned in the middle of a sector-shaped spray 144, and spray injected from the injection holes 143 are positioned outside the sector-shaped spray 144 in a spread direction or fashion. The diameters of the injection holes 141, 142 are equal to each other, and the diameters of the injection holes 141, 142 are larger than that of the injection hole 143. The amount of fuel injected from the injection hole 141 or 142 is more than that from the injection hole 143, so that spray concentration is higher in the middle and close to the middle of the sector-shaped spray 144 than in the outer area of the spray. Accordingly, the force of penetration is stronger in the outer area of the sector-shaped spray 144 than in the middle.

Seventh and Eighth Embodiments

Figure 11A:
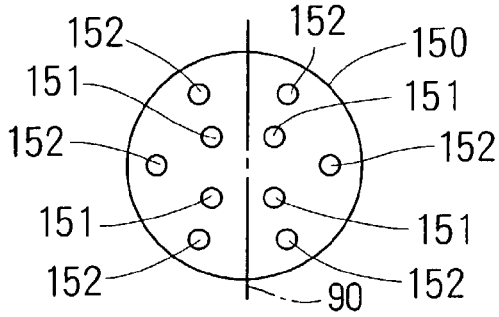
FIG. 11A is a plan view of an injection hole plate according to a seventh embodiment of the present invention.
Figure 11B:
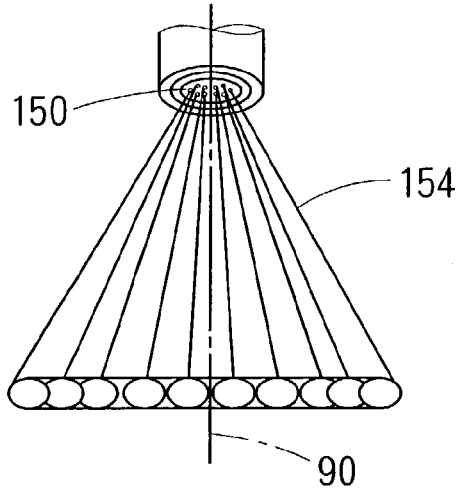
FIG. 11B is a schematic diagram showing a spray shape.
Figure 12A:
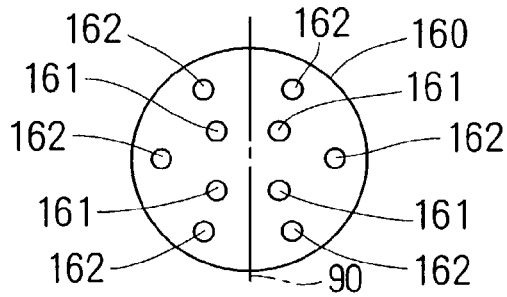
FIG. 12A is a plan view of an injection hole plate according to an eighth embodiment of the present invention.
Figure 12B:
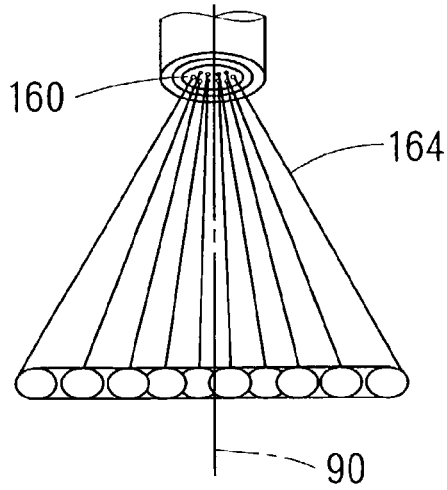
FIG. 12B is a schematic diagram showing a spray shape.

FIGS. 11 and 12 show seventh and eighth embodiments, respectively, of the present invention. The positions of injection holes 151, 152 formed in an injection hole plate 150 of the seventh embodiment, and the positions of the injection holes 161, 162 formed in an injection hole plate 160 of the eighth embodiment are the same as those of the injection holes 121, 122 of the third embodiment shown in FIG. 7. The injection holes 151, 161, as inner injection holes, correspond to the injection holes 121, and the injection holes 152, 162 correspond to the injection holes 122. The diameters of the injection holes 151, 152, 161, and 162 are equal to each other.

In the third embodiment, as shown in FIG. 7, the spray concentration of the sector-shaped spray 124 is almost even in the spread direction of the sector-shaped spray 124. In the seventh embodiment of FIG. 11, on the other hand, the spray concentration is high in both outer areas of the sector-shaped spray 154, but low in the middle by adjusting the angle of gradient of the injection holes 151, 152. In the eighth embodiment of FIG. 12, the spray concentration is low in both outer areas of the sector-shaped spray 164 and high in the middle of the sector-shaped spray 164.

Ninth Embodiment

Figure 13A:
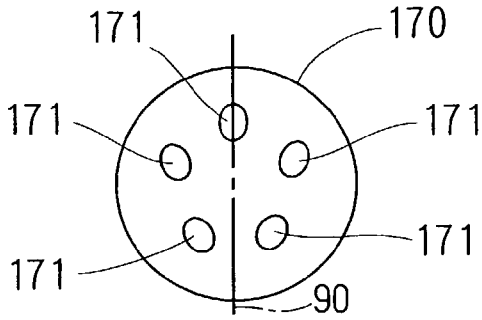
FIG. 13A is a plan view of an injection hole plate according to a ninth embodiment of the present invention.
Figure 13B:
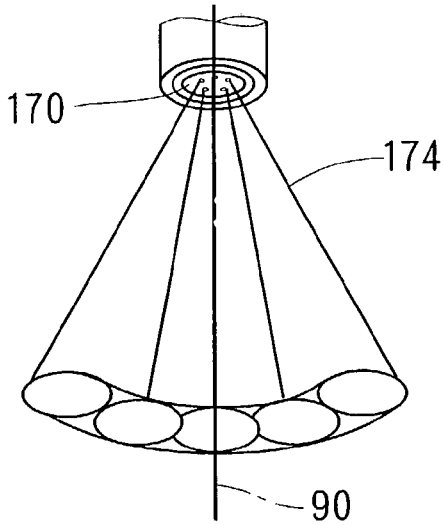
FIG. 13B is a schematic diagram showing a spray shape.
Figure 14:
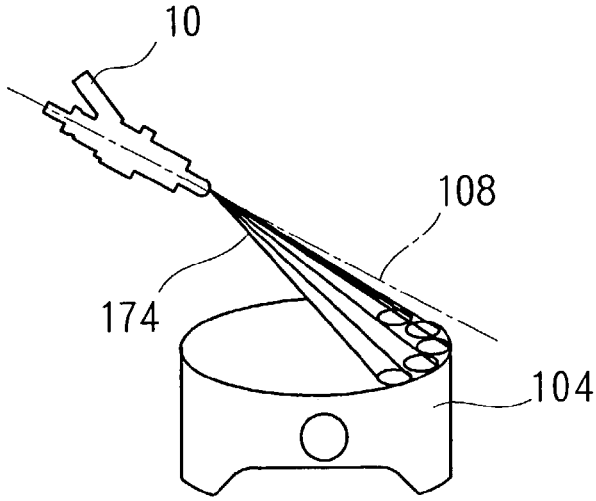
FIG. 14 is a perspective view showing the spray condition of an injector according to the ninth embodiment.

FIGS. 13 and 14 show a ninth embodiment of the present invention. Five injection holes 171, the diameters of which are equal to each other, are formed in an injection hole plate 170 and arranged on the same circle. The farther the injection holes 171 are away from the imaginary plane 90, the larger the angles of gradient formed by the injection holes 171 with respect to the imaginary plane 90 become.

Spray injected from the injection holes 171 form a sector-shaped spray 174 which is flat and curved. The spray concentration of the sector-shaped spray 174 is almost even in the spread direction of the sector-shaped spray 174. The flat and curved sector-shaped spray 174, as shown in FIG. 14, is injected toward a boundary between the upper surface of the piston 104 and the inner periphery of the cylinder block 100 (referring to FIG. 4), in such a manner as to fit a curved surface in the outer edge of the circular upper end of the piston 104.

Since the sector-shaped spray 174 is injected to the farthest position from the injection holes of the injector 10, the force of penetration is weakened when the sector-shaped spray 174 reaches the upper surface of the piston 104 and the inner periphery of the cylinder block 100 (referring to FIG. 4), so that the fuel is prevented from liquefying in the upper surface of the piston 104 and the inner periphery of the cylinder block 100 (referring to FIG. 4). Accordingly, it is possible to decrease the generation of non-combusted fuel.

Tenth, Eleventh, and Twelfth Embodiments

Figure 15A:
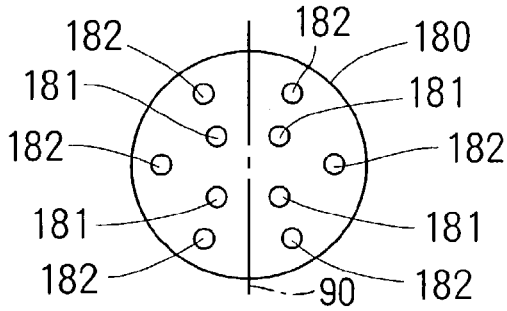
FIG. 15A is a plan view of an injection hole plate according to a tenth embodiment of the present invention.
Figure 15B:
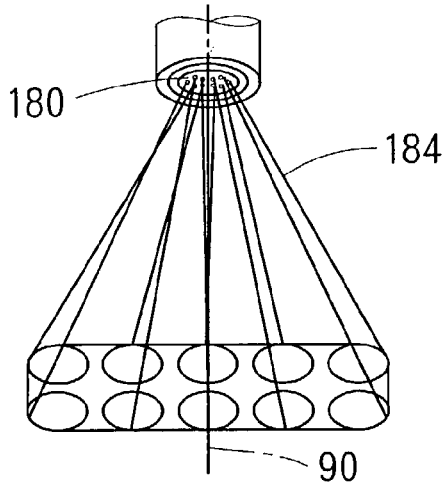
FIG. 15B is a schematic diagram showing a spray shape.
Figure 16A:
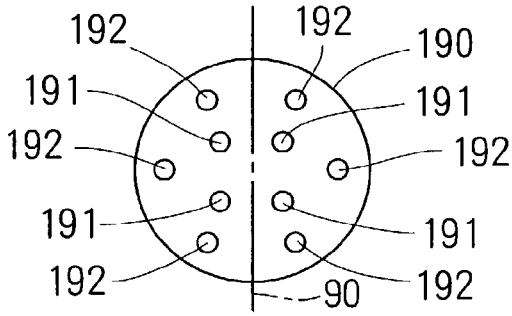
FIG. 16A is a plan view of an injection hole plate according to an eleventh embodiment of the present invention.
Figure 16B:
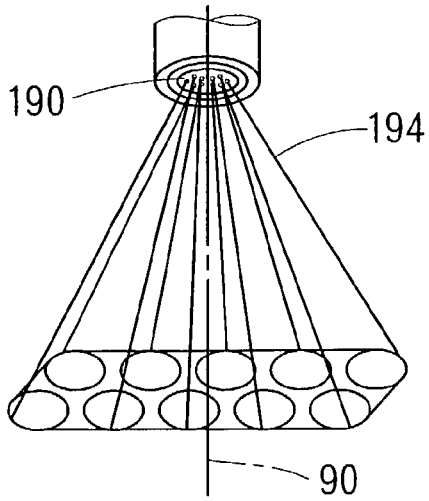
FIG. 16B is a schematic diagram showing a spray shape.
Figure 17A:
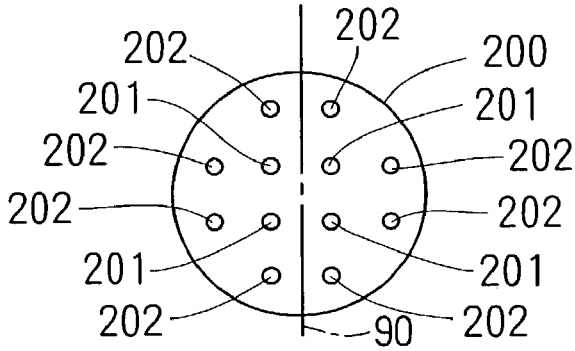
FIG. 17A is a plan view of an injection hole plate according to a twelfth embodiment of the present invention.
Figure 17B:
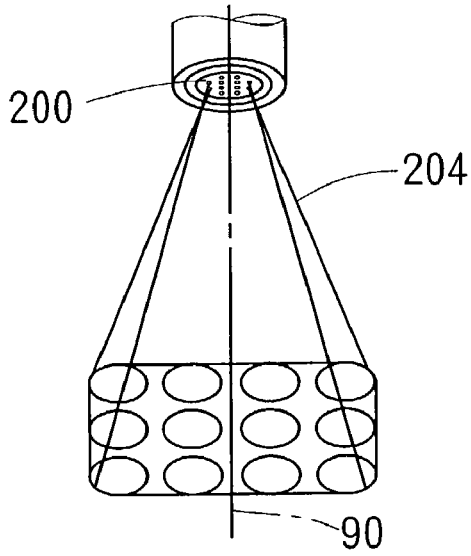
FIG. 17B is a schematic diagram showing a spray shape.

FIGS. 15, 16, and 17 show tenth, eleventh, and twelfth embodiments, respectively, of the present invention. The positions of injection holes 181, 182 formed in an injection hole plate 180 of the tenth embodiment, the positions of injection holes 191, 192 formed in an injection hole plate 190 of the eleventh embodiment, and the positions of injection holes 201, 202 formed in an injection hole plate 200 of the twelfth embodiment are the same as those of the injection holes 121, 122 of the third embodiment. The injection holes 181, 191, and 201, as inner injection holes, correspond to the injection holes 121, and the injection holes 182, 192, and 202 correspond to injection holes 122. The diameters of the injection holes 181, 182, 191, 192, 201, and 202 are equal to each other.

In the third embodiment, as shown in FIG. 7, the spray injected from the injection holes 121, 122 is arranged in a line. In the tenth embodiment, on the other hand, the spray injected from the injection holes 181, 182 is arranged in two rows to form a flat sector-shaped spray 184. The spray concentration is almost even in the sector-shaped spray 184. In the eleventh embodiment of FIG. 16, the spray injected from the injection holes 191, 192 is arranged in two rows one of which is shifted, to form a flat sector-shaped spray 194. In the shifted row arrangement, part of each row in its longitudinal direction does not overlap the row next to it. The spray concentration is almost even in the sector-shaped spray 194. In the twelfth embodiment of FIG. 17, spray injected from the injection holes 201, 202 are arranged in three rows to form a flat sector-shaped spray 204. The spray concentration is almost even in the sector-shaped spray 204.

Thirteenth, Fourteenth, and Fifteenth Embodiments

Figure 19:
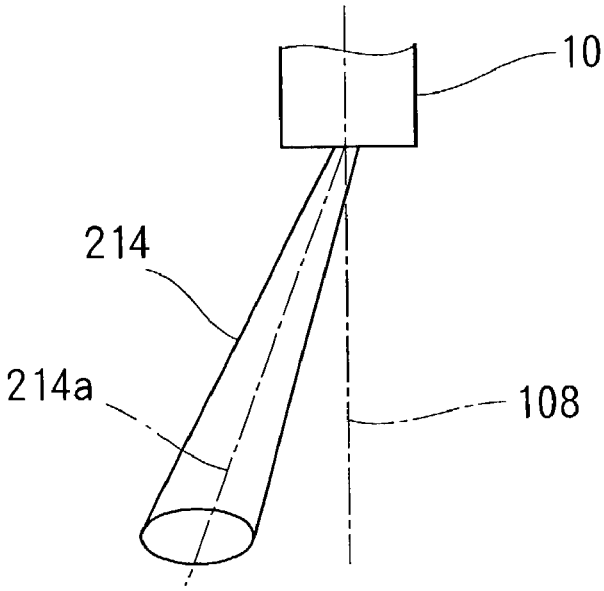
FIG. 19 is a schematic diagram showing the inclined direction of a sector-shaped spray.
Figure 18A:
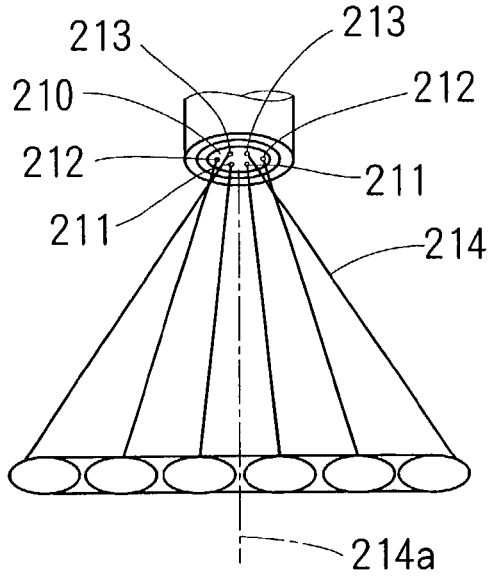
FIG. 18A is a perspective view of the arrangement of injection holes and the position of spray according to a thirteenth embodiment of the present invention.
Figure 18B:
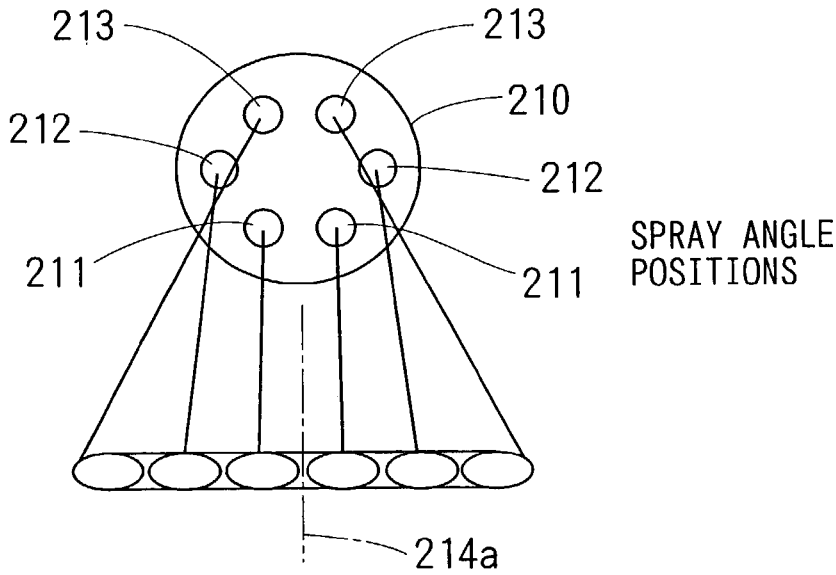
FIG. 18B is a plan view of the arrangement of the injection holes and the injection positions.
Figure 20:
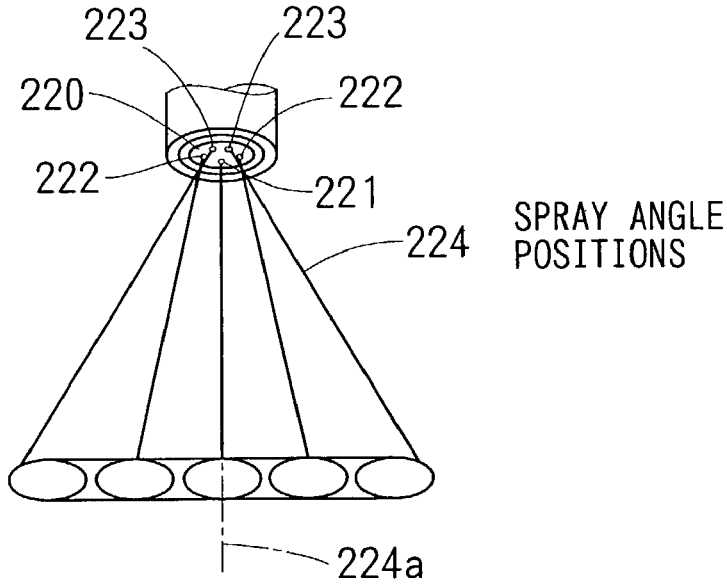
FIG. 20 is a perspective view showing an arrangement of injection holes and the position of spray according to a fourteenth embodiment of the present invention.
Figure 21:
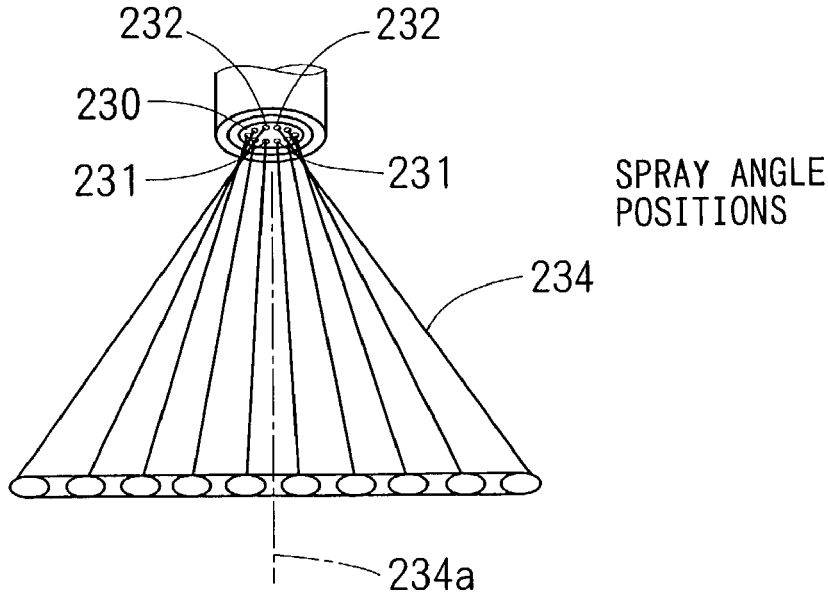
FIG. 21 is a perspective view showing an arrangement of injection holes and the position of spray according to a fifteenth embodiment of the present invention.
Figure 22A:
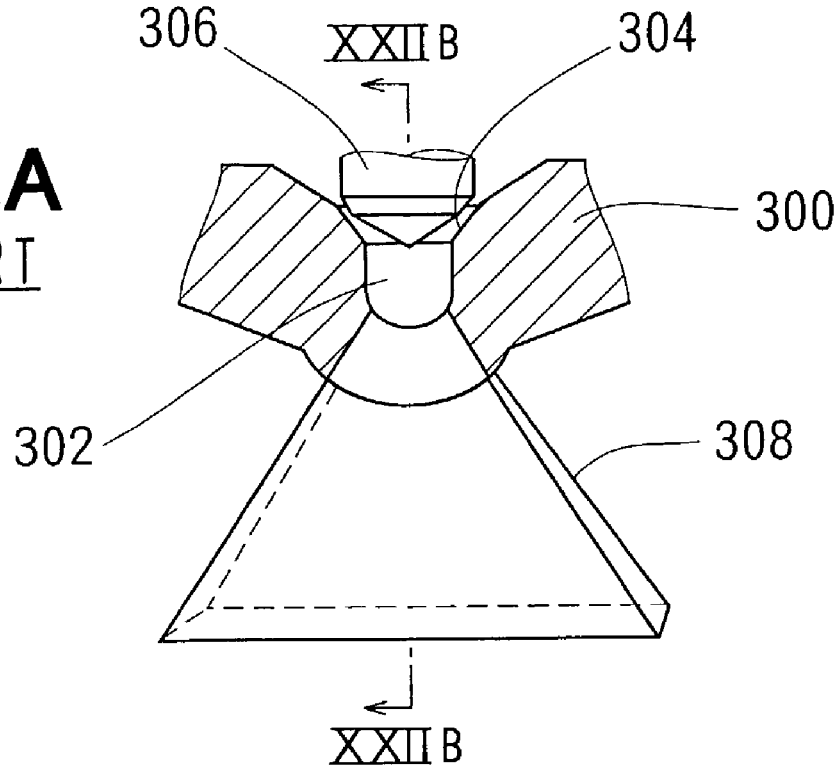
FIG. 22A PRIOR ART
FIG. 22A is a cross-sectional view showing an injection hole and a spray shape according to a first prior art example.
Figure 22B:
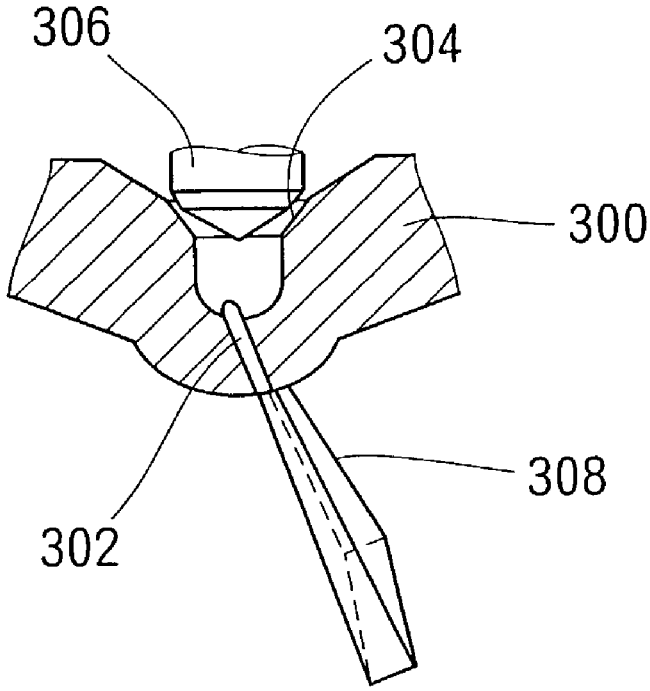
FIG. 22B PRIOR ART
FIG. 22B is a cross-sectional view taken along the line XXIIB—XXIIB in FIG. 22A.
Figure 23A:
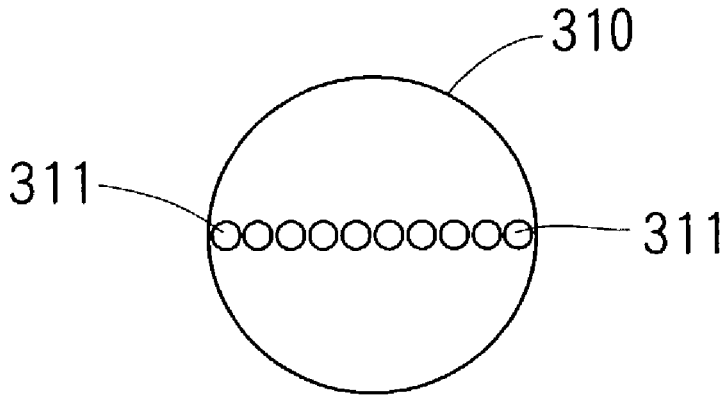
FIG. 23A PRIOR ART
FIG. 23A is a plan view of an injection hole plate according to a second prior art example.
Figure 23B:
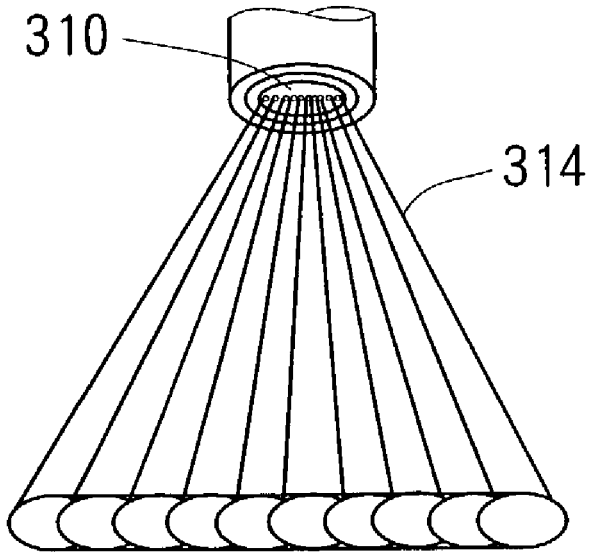
FIG. 23B PRIOR ART
FIG. 23B is a schematic diagram showing a spray shape according to the second prior art example.

FIGS. 18A, 18B and 19 show a thirteenth embodiment of the present invention, and FIGS. 20 and 21 show fourteenth and fifteenth embodiments, respectively. In the thirteenth embodiment, as shown in FIGS. 18A and 18B, six injection holes 211, 212, and 213 in total, the diameters of which are equal to each other, are formed in an injection hole plate 210 and are arranged on the same single circle according to a regular interval. A sector-shaped spray 214, as shown in FIG. 19, travels away from the axial line 108 of the injector 10, namely is inclined with respect to the axial line 108. That is, the sector-shaped spray 214 gets farther away from the axial line 108 as the spray gets farther away from the injector 10, that is, as the spray 214 advances in the advancing direction.

In the injection hole plate 210, the injection holes 211 are the closest to the inclined side of the sector-shaped spray 214, and the injection holes 212 and injection holes 213 are farther away from the inclined side of the sector-shaped spray 214, in this order. The farther the injection hole is away from the inclined side of the sector-shaped spray 214, the more inclined the injection hole is from the central axis 214*a* of the sector-shaped spray, along the injection direction, to a spread direction of the sector-shaped spray 214. In other words, the injection holes 213 are most inclined to the spread direction of the sector-shaped spray 214, and the injection holes 212 and injection holes 211 are less inclined, in this order. Accordingly, spray injected from the injection holes 211 is positioned in the middle of the sector-shaped spray 214, spray injected from injection holes 212 is positioned outside the spray from injection holes 211, and spray injected from injection holes 213 is positioned in the most outside position of the sector-shaped spray 214.

In the fourteenth embodiment shown in FIG. 20, five injection holes 222, the diameters of which are equal to each other, are formed in an injection hole plate 220 and arranged on the same single circle according to a regular interval. As with the thirteenth embodiment of FIG. 19, a sector-shaped spray 224 travels away from the axial line 108 of the injector 10, namely is inclined with respect to the axial line 108, as the spray advances in the injection direction.

In the injection hole plate 220, the injection hole 221 is the closest to the inclined side of the sector-shaped spray 224, and the injection holes 222 and injection holes 223 are farther away from the inclined side of the sector-shaped spray 224, in this order. The farther the injection hole is away from the inclined side of the sector-shaped spray 224, the more inclined the injection hole is from the central axis 224*a* of the sector-shaped spray, along the injection direction, to a spread direction of the sector-shaped spray 224. In other words, the injection holes 223 are more inclined than the injection holes 221. Accordingly, spray injected from the injection holes 221 is positioned in the middle of the sector-shaped spray 224, and spray injected from the injection holes 222 is positioned outside the spray injected from the injection holes 221, and spray injected from the injection holes 223 is positioned in the most outside position of the sector-shaped spray 224.

In the fifteenth embodiment shown in FIG. 21, ten injection holes 232, the diameters of which are equal to each other, are formed in an injection hole plate 230 and arranged on the same single circle according to a regular interval. As with the thirteenth embodiment of FIG. 19, a sector-shaped spray 234 travels away from the axial line 108 of the injector 10, namely is inclined with respect to the axial line 108, while advancing in the injection direction. In the injection hole plate 230, the injection holes 231 are the closest to the inclined side of the sector-shaped spray 234, and distance from the inclined side of the sector-shaped spray 224 increases while advancing from the injection holes 231 toward the injection holes 232. The farther the injection hole is away from the inclined side of the sector-shaped spray 234, the more inclined the injection hole is from the central axis 234*a* of the sector-shaped spray along the injection direction to the spread direction of the sector-shaped spray 234. In other words, the injection holes 232 are more inclined than the injection holes 231. Accordingly, spray injected from the injection holes 231 are positioned in the middle of the sector-shaped spray 234, and injection position spreads spray to the outside of the sector-shaped spray 234, as the injection hole 232 is away from the inclined side of the sector-shaped spray 234.

According to the thirteenth, fourteenth and fifteenth embodiments, as described above, the farther an injection hole is away from the inclined side of a sector-shaped spray with respect to the axial line 108 of the injector 10, the more inclined the injection hole is from the central axis of the sector-shaped spray along the injection direction to the spread direction of the sector-shaped spray, so that it is possible to prevent the spray from the respective injection holes from interfering and uniting with each other. Therefore, it is possible to promote the atomization of the sector-shaped spray.

In the thirteenth, fourteenth and fifteenth embodiments, all injection holes are arranged on the same single circle. However, it may be possible to form at least one injection hole in the outermost circle, and to form the other injection holes in such a manner that the farther the injection hole is away from the inclined side of a sector-shaped spray with respect to the axial line 108 of the injector 10, the more inclined the injection hole is from the central axis of the sector-shaped spray along the injection direction to the spread direction of the sector-shaped spray. The injection holes formed inside the outermost circle may be arranged on a plurality of circles which are concentric with the outermost circle.

In the above-described plurality of embodiments, the injection holes are formed and arranged on the outermost circle at approximately regular intervals in the circumferential direction. In a case where the injection holes are formed inside the outermost circle, the injection holes are evenly positioned inside the outermost circle, or the injection holes are positioned in such a manner that intervals between the inner injection hole formed inside the outermost circle and the outermost injection hole adjacent to the inner injection hole, and between the inner injection hole and another inner injection hole are almost equal to each other. Therefore, the strength of the injection hole plate increases because the intervals between the injection holes increases as much as possible within an area where the injection holes are formed.

It is also possible to prevent the spray from each injection hole from interfering and uniting with each other. Therefore, the atomization of the sector-shaped spray is promoted. Furthermore, since the fuel is injected from each injection hole to a desired direction, it is possible to obtain a spray in a desired shape. When the inner injection hole is formed inside the outermost circle, the number of the inner injection hole may be at least one. In a case where a plurality of inner injection holes are formed, if the number of the inner injection holes is two, it is possible to position the inner injection holes in such a manner that intervals between the inner injection holes and the outermost injection hole adjacent to the inner injection holes, and between the inner injection hole and its inner injection hole counterpart are almost equal to each other.

Even if the injection hole plate is thin, it is possible to increase the plate strength within an area where the injection holes are formed, so that the fuel injection device according to the present invention is suitably applicable to a direct-injection gasoline engine with high fuel injection pressure. Since it is possible to make the thickness of the injection hole plate thin, the fuel flow is rectified to a low degree while passing through the injection holes, so that the spray is atomized. The thin injection hole plate makes it possible to machine the injection holes by press working. Accordingly, it is easy to machine the injection holes. In a case of applying laser machining or electric discharge machining, machining time becomes shorter.

It is also possible to easily change the shape of the sector-shaped spray or concentration distribution by means of adjusting the diameters of a plurality of injection holes formed in the injection hole plate or the angle of gradient thereof. Therefore, the spray is designed with a high degree of flexibility.

In the plurality of embodiments described above, the injection hole plate with the inner holes, arranged on the inner circle that is concentric with the outermost circle, has double concentric circles on which the injection holes are arranged. More than three concentric circles, however, may be provided if possible. When the injection hole plate has a plurality of circles on which the injection holes are arranged, the centers of the circles may not coincide. When at least one inner injection hole group is arranged inside the outermost injection hole group arranged on the outermost circle, the injection holes constituting each inner injection hole group may not be arranged on the same circle. In a case where the injection holes are formed inside the outermost circle, the injection holes may be arranged almost evenly inside the outermost circle, or may be arranged unevenly inside it.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel injection device for injecting fuel as a flat sector-shaped spray directly into a combustion chamber of an internal-combustion engine, the fuel injection device comprising:

a valve body having a valve seat in an inner periphery thereof;

an injection hole plate, defining a plurality of injection holes, and disposed downstream in a fuel flow from said valve seat for injecting the fuel; and a valve member seating on said valve seat to interrupt fuel injection from said injection holes, and separating from said valve seat to allow said fuel injection from said injection holes, wherein a plurality of outermost injection holes out of said plurality of injection holes are formed as three or more arranged on a common circle.

2. The fuel injection device according to claim 1, wherein the sector-shaped spray travels away from an axial line along a seating direction of said valve member on said valve seat, while advancing in an injection direction, and said sector-shaped spray is inclined with respect to said axial line.

3. The fuel injection device according to claim 2, wherein the farther said injection hole is away from an inclined side of said sector-shaped spray, the more inclined said injection hole is to a spread direction of said sector-shaped spray, with respect to a central axis of said sector-shaped spray along said injection direction.

4. The fuel injection device according to claim 1, wherein the farther said injection hole is away from an imaginary plane, the larger an angle of gradient thereof with respect to said imaginary plane becomes, said imaginary plane containing a central axis of said sector-shaped spray along an injection direction and being orthogonal to said sector-shaped spray.

5. The fuel injection device according to claim 4, wherein intervals between said outermost injection holes adjacent to each other in a circumferential direction are approximately equal to each other.

6. The fuel injection device according to claim 5, wherein at least one inner injection hole is formed inside said outermost injection holes.

7. The fuel injection device according to claim 6, wherein said injection hole plate has at least one inner injection hole group formed inside an outer injection hole group including said outermost injection holes, and one of said outer injection hole group and said inner injection hole group is disposed outside each of said inner injection hole groups, in such a manner as to be opposed to each of said inner injection hole groups.

8. The fuel injection device according to claim 7, wherein said outer and inner injection hole groups comprise a plurality of injection holes formed and arranged on a plurality of concentric circles, and intervals between said injection holes adjacent to each other in a circumferential direction of each circle are approximately equal to each other.

9. The fuel injection device according to claim 8, wherein three or more of said inner injection holes are formed inside said outermost injection holes, and intervals between said inner injection holes adjacent to each other are approximately equal to each other.

10. The fuel injection device according to claim 6, wherein intervals between adjacent said inner injection hole and said outermost injection hole are approximately equal to each other.

11. The fuel injection device according to claim 10, wherein a plurality of inner injection holes are formed inside said outer injection holes, and intervals between each of said inner injection holes and said outermost injection holes adjacent thereto and between each of said inner injection holes and another inner injection hole are approximately equal to each other.

12. The fuel injection device according to claims 11, wherein said plurality of injection holes are formed in said injection hole plate, exclusive of a middle portion thereof.

13. The fuel injection device according to claim 12, wherein diameters of said plurality of injection holes are equal to each other.

14. The fuel injection device according to claim 12, wherein diameters of said plurality of injection holes are different from each other.

15. The fuel injection device according to claim 1, wherein said injection hole plate satisfies $t/d \leqq 1.5$, wherein "t" is a thickness of said injection hole plate, and "d" is the diameter of said plurality of injection holes.

16. The fuel injection device according to claim 15, wherein an end surface of said valve member and a surface of said injection hole plate define a fuel space.

17. The fuel injection device according to claim 1, wherein said sector-shaped spray includes a plurality of sprays corresponding to the plurality of outermost injection holes, said plurality of sprays being arranged to collectively define a substantially straight spray line.

18. The fuel injection device according to claim 1, wherein all of the injection holes defined through said injection hole plate are arranged on said common circle.

19. The fuel injection device according to claim 1, wherein there are five injection holes defined through said injection hole plate.

* * * * *